US005401068A

United States Patent [19]

Barnard

[11] Patent Number: 5,401,068

[45] Date of Patent: Mar. 28, 1995

[54] PORTABLE DOOR LOCKING MECHANISM

[76] Inventor: Robert N. Barnard, 22 Thornton Ave., Lowell, Mass. 01852

[21] Appl. No.: 241,615

[22] Filed: May 11, 1994

[51] Int. Cl.[6] ..... E05C 19/18

[52] U.S. Cl. ..... 292/289; 292/295; 292/292

[58] Field of Search ..... 292/289, 291, 292, 288, 292/295

[56] References Cited

U.S. PATENT DOCUMENTS

| | | | |
|---|---|---|---|
| 939,785 | 11/1909 | Auger . | |
| 1,590,133 | 6/1926 | Tennyson | 292/292 |
| 1,947,773 | 2/1934 | Haviland | 292/292 |
| 3,352,587 | 11/1967 | Harvey | 292/289 |
| 3,421,787 | 1/1969 | Hoffman et al. | 292/289 |
| 3,432,199 | 3/1969 | Sorrell . | |
| 3,451,235 | 6/1969 | Weingart . | |
| 3,596,961 | 8/1971 | Lippman . | |
| 3,913,962 | 10/1975 | Briggs . | |
| 4,072,333 | 2/1978 | Hutter, III . | |
| 4,471,981 | 9/1984 | Wright . | |
| 4,878,701 | 11/1989 | Rondel et al. . | |
| 4,898,411 | 2/1990 | Ocello et al. . | |
| 5,193,867 | 3/1993 | Husted | 292/292 |

*Primary Examiner*—Peter M. Cuomo
*Assistant Examiner*—Monica E. Millner
*Attorney, Agent, or Firm*—Pearson & Pearson

[57] ABSTRACT

A portable door lock comprises a planar lock plate for extending from a door frame and a door edge with a transverse tongue at one end that passes through a frame striker plate into a recess. Apertures in a central portion of the lock plate align with apertures in a block that slides on the lock plate. A locking pin extends through registered apertures in the block and lock plate to lock the block relative to the lock plate when the block is slid against the door.

16 Claims, 2 Drawing Sheets

PORTABLE DOOR LOCKING MECHANISM

BACKGROUND OF THE INVENTION

1. Field of the Invention

This invention relates to door locks generally and, more particularly, to portable door locking mechanisms.

2. Description of Related Art

Portable door locks of various designs are known. Such locks secure doors not having locks, doors with broken, defective, or otherwise ineffective locks, and doors where a user wishes to personally control access (e.g., eliminate otherwise authorized key entry). The use of portable door locks to control access is particularly desired in public lodgings, such as hotels, motels, dormitories, apartments, cruise ships and the like. As will be apparent, these portable door locks should be compact, strong, light weight, inexpensive to manufacture, simple to use and be constructed as an integral unit. Moreover, such portable door locks should operate with a wide variety of door and frame styles and should not mar the door, door frame and other associated parts when used.

The following United States Letters Patent disclose examples of portable door locks:

U.S. Pat. No. 939,785 (1909) Auger
U.S. Pat. No. 3,432,199 (1967) Sorrell
U.S. Pat. No. 3,451,225 (1967) Weingart
U.S. Pat. No. 3,596,961 (1971) Lippman
U.S. Pat. No. 3,913,962 (1975) Briggs
U.S. Pat. No. 4,072,333 (1978) Hutter, III
U.S. Pat. No. 4,471,981 (1984) Wright
U.S. Pat. No. 4,878,701 (1989) Rondel et al.
U.S. Pat. No. 4,898,411 (1990) Ocello et al.

U.S. Pat. No. 939,785 to Auger discloses a portable door lock which includes a plate having a tongue that extends into a recess of a striker plate mounted on a door frame and associated with a conventional door latch. A slot in the plate slidably supports a pin which, in turn, slidably supports a locking plate. Oblique recesses extend from the slot to receive the pin and position the locking plate. The locking plate has a relatively narrow flange that bears against the door. This portable door lock thereby produces a clamping force acting against the door and the striker plate. To use the device on an oppositely arranged door the locking plate must be rotated on the pin so that a second, similar bearing surface, bears on the door. In either orientation this lock provides a relatively narrow elongated bearing surface along the door. This narrow elongated bearing surface increases the likelihood of damage to a door opened against the lock.

In U.S. Pat. No. 3,451,225 to Weingart a flat hook bar extends through an aperture in a guard plate. The flat hook bar extends between a door and a frame and carries a transverse tongue that extends into a keeper recess. Insertion of a locking plate carried by the guard plate into one of a series of slots formed in the flat hook bar spaced from the tongue fixes the guard plate proximate the door and the frame. The guard plate bears on both the door and the keeper proximate the door. The lock taught by Weingart is limited to applications where the frame and the surface of the door are substantially co-planar when the door is closed, thus the lock is not readily useable with or risks damage to doors and door frames having raised, peripheral portions, such as moldings.

U.S. Pat. No. 3,596,961 to Lippman discloses a plate or latch bar having a transverse tongue that extends into a keeper recess. A series of teeth on the latch bar engage leg tabs on a resilient metal blocker to retain the blocker in position on the latch bar. In a final position an extension member on the blocker bears against the door. The parts of this device can separate and so are subject to being lost.

Each of U.S. Pat. No. 3,432,199 to Sorrel and U.S. Pat. No. 3,913,962 to Briggs discloses a portable door lock comprising a plate having a tongue extending therefrom to reside in a recess formed through a keeper. The plate extends transversely to the plane of the door and includes an inverted V-shaped slot for receiving a bolt that bears against the door. In Sorrel the V-shaped slot is smooth and the bolt is slidably fixed within the slot. In Briggs the slot has an enlarged portion allowing insertion and extraction of the bolt from the slot and serrated edges within the slots for improved retention of the bolt thereat. The bolt in each of these references is cylindrical and provides only a minimal bearing surface at which clamping forces act. This increases the risk of damage to the door when it is opened against the lock.

U.S. Pat. No. 4,072,333 to Hutter teaches a plate having a tongue which extends into a keeper recess. The plate includes at least one pin which laterally extends through a slot in a wedge so as to support the wedge. Detents positioned along the slot position proximate the door to resist the door being opened.

U.S. Pat. No. 4,471,981 to Wright teaches a portable lock having a plate with a tongue which extends into a keeper recess. Edges along the plate include opposed teeth located distally from the door frame. The plate extends through a portion of an aperture in a locking piece. A connected portion of the aperture engages the teeth of the plate to fix the locking piece proximate the door to thereby lock the door. The locking pieces disclosed by Wright are particularly adapted to specific types of doors. That is, a locking piece according to this reference that is adapted for use with a flush mount door is not suitable for doors in molded frames. The converse is also true. Additionally, a minimal bearing surface of the metal locking piece increases the risk of door damage.

U.S. Pat. No. 4,878,701 to Rondel et al. discloses a portable door lock having a plate which extends between the door and frame with a tongue for extending into a keeper recess. A handle portion slidable secured in a slot of the plate moves angularly with respect to the plate to lock the door. Specifically, rotation of the handle causes a serrated dog to cam into engagement with a serrated surface of the slot to lock the handle in place. This device, while seemingly effective, only provides a minimal bearing surface against the door and is relatively complex.

U.S. Pat. No. 4,898,411 Ocello et al. disclose a plate for extending between a door and a frame which includes a tongue for extending into a keeper recess. The plate includes slots into which a bolt may be placed to secure the door in a closed position. The bolt, having a circular cross-section, provides a minimal bearing surface against the door and increases the likelihood of door damage.

SUMMARY

Accordingly, it is an object of the present invention to provide a portable door look which is relatively simple to use and manufacture.

It is another object of the present invention to provide a door lock which is effective while substantially reducing the risk of damage to a door and associated frame.

It is also an object of this invention to provide a portable door lock which is relatively light weight, small, and easily packed.

It is also a further object of the present invention to provide an integral portable door lock which reduces the risk of damage to doors while being effective in locking a wide range of doors.

In accordance with one aspect of this invention a portable door locking mechanism includes a lock plate comprising an elongated planar section having an end portion for extending intermediate a door and a frame, a transversely extending tongue at the end portion for engaging a recess through a striker in the frame, and a first pattern of apertures extending through the planar section and spaced from the end portion. A block slidably mounts on the planar section with a door engaging surface transverse to the planar section and a second pattern of apertures extending through the block. At different relative positions of the planar section and block at least one aperture in each of the first and the second patterns come into are substantial registration. A locking pin can be inserted through the substantially registered apertures to fix the block relative to the plate and clamp the door to the door frame.

In accordance with another aspect of this invention an integral portable door lock comprises a lock block having a pattern of apertures formed therein and a back plate with a second pattern of apertures formed therein. The black plate is secured to the lock block to define a channel therebetween and so as to register the apertures of the first and second patterns. A lock plate slidably secured within the channel comprises a substantially planar sheet having spaced and opposed, first and second end portions sized for positioning intermediate a door and a frame, a first and second transverse tongues extending from the first and second end portions, respectively, and a third pattern of apertures extending through the lock plate intermediate the first and second end portions. At least one aperture of the third pattern comes into substantial registration with one aperture in each of the first and second pattern of apertures at different relative positions of the lock plate with respect to the lock block and back plate. A peg flexibly fastened to the lock block has a body for insertion the registered apertures in the first, second and third patterns of apertures to fix the back plate and lock block relative to said lock plate.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
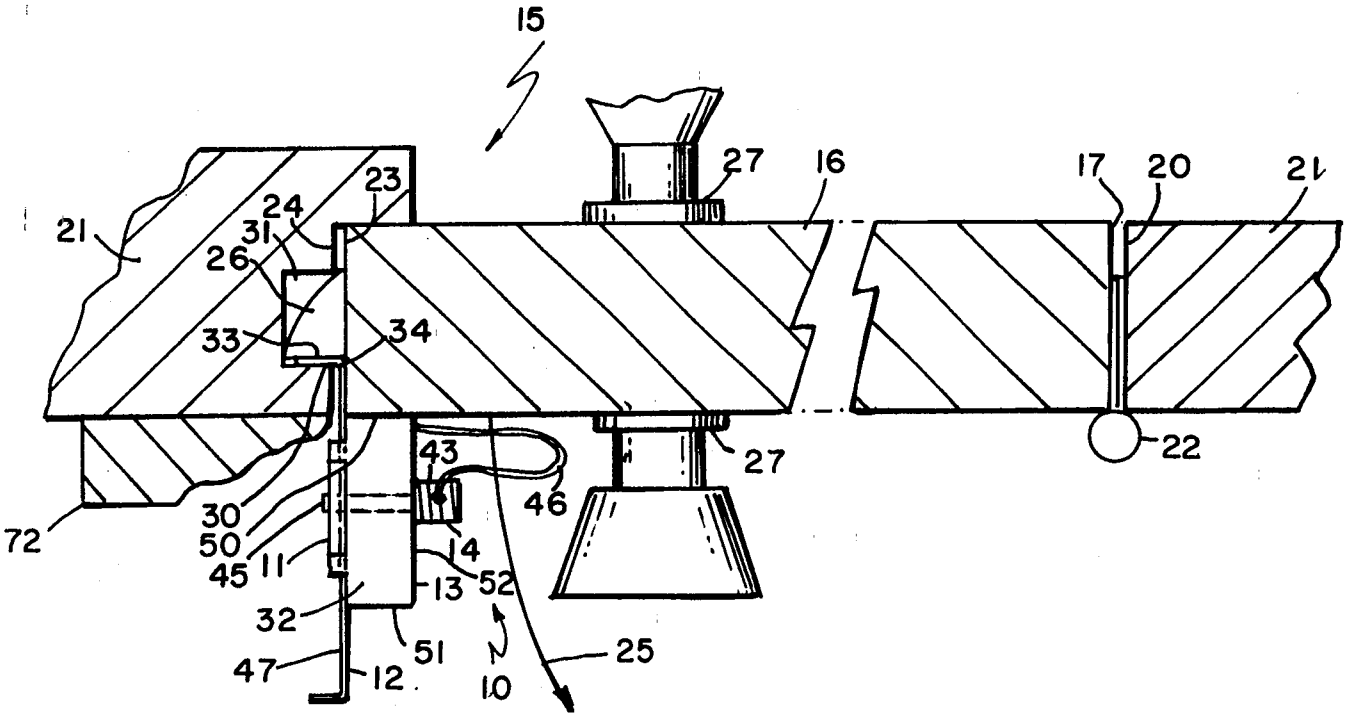
FIG. 1 is a top section view of a door system in which a portable door lock constructed in accordance with the present invention is used.

In FIG. 1, a portable door lock 10 according to the present invention includes a back plate 11, a lock plate 12, a lock block 13, and a lock pin 14 for use with a typical door system 15. The door system includes a door 16 secured along a hinge edge 17 to a hinge side of a frame 21 by hinges 22 (only one of which is shown). The hinges 22 support the door for movement between the depicted closed position and an open position with a door latch edge 23 swung away from a second latch side 24 of the frame 21 in the direction of arrow 25.

The door system 15 of FIG. 1 also includes a selectively retractable latch 26 in the door 16 operated by a manual door handle or knob plus associated bases 27. A striker plate 30 receives the latch 26 in a recess 31 formed in the frame 21 at the latch side 24 through an aperture in the striker plate 30.

Continuing to refer to FIG. 1, the back plate 11 and lock block 13 capture the lock plate 12 so the lock plate 12 can slide therebetween and they constitute a unitary block 32. The lock plate 12 is an elongated planar structure having a thickness that enables the lock plate 12 to be positioned between the closed door 16 and the striker plate 30. When the lock plate 12 is positioned along an axis that is normal to the plane of the door, a tongue 33 disposed proximate a first end portion 34 extends through the striker plate 30 into the recess 31.

Figure 2:
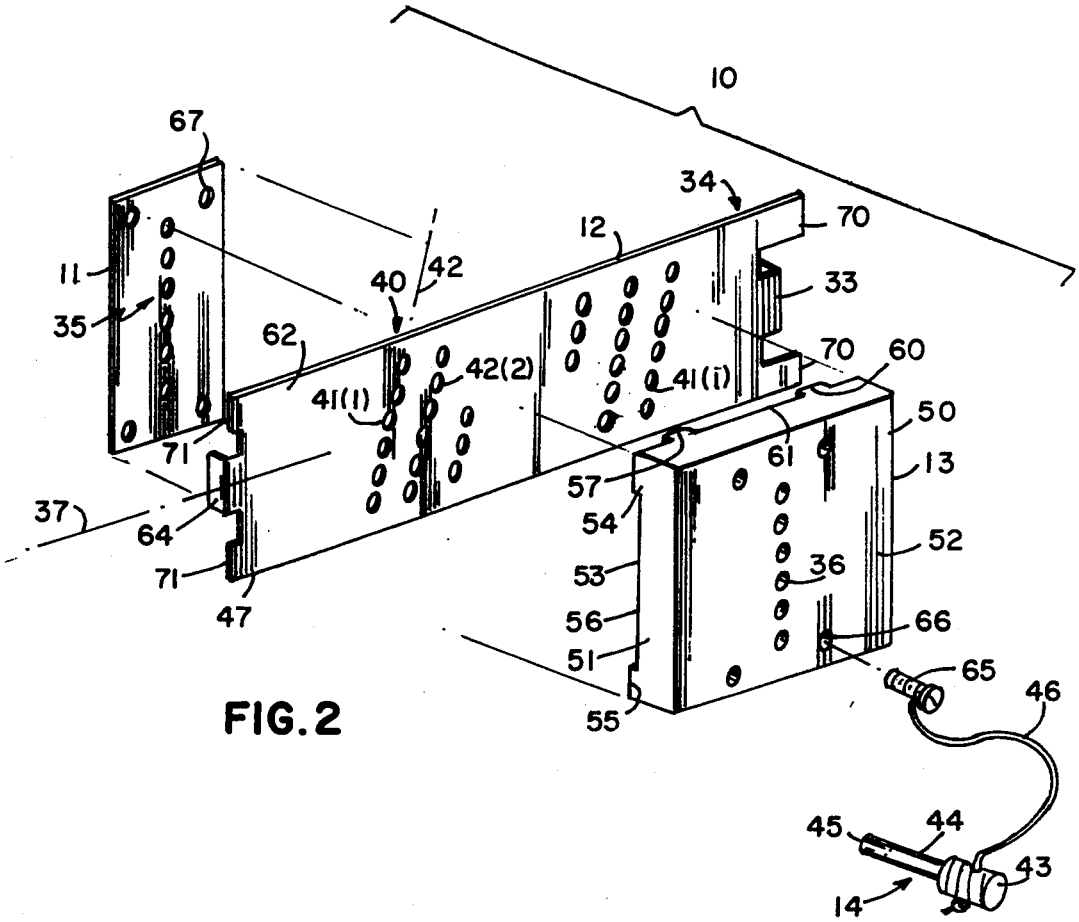
FIG. 2 is a perspective exploded view of the portable door lock of FIG. 1.

Now referring to FIG. 2, the back plate 11 and lock block 13 having linear arrays 35 and 36 of apertures respectively. Each of the arrays 35 and 36 extends along a line that is parallel to the plane of the door 16 in FIG. 1 and transverse to a lock plate axis 37.

The lock plate 12 also includes an array 40 of apertures. The array 40 comprises a plurality of columns 41(1), 41(2) . . . 41(i) that lie along parallel axes. Each axis, such as axis 42 intersects the axis 37 at an angle $\Theta$. As will be apparent, if $\Theta<90°$, individual apertures in the array 40 will come into registration with apertures in the arrays 35 and 36 as the lock plate 12 moves along the axis 37 relative to the back plate 11 and the lock block 13 (i.e., the block 32). The selection of a particular angle $\Theta$ and spacing between adjacent apertures in each array 41 along the axis 37 will determine the incremental displacement of the lock plate 12 between positions at which apertures come into registration. Once the apertures are in registration, the pin 14 passes through the registered apertures and fixes the position of the lock plate 12 with respect to the back plate 11 and lock block 13.

In one embodiment each aperture has a 0.20" diameter. The spacing between centers of the apertures in the arrays 35 and 36 is 0.248" and $\Theta=76°$. With these dimensions the displacement between successive registration positions is about 0.062" (i.e., less than 1/16"). Moreover, if pairs of apertures have more than a 50% overlap, the pin 14 inserts easily through the apertures and displaces the lock plate less than 1/32". Consequently, the aperture arrays 35, 36 and 40 provide a means for enabling the lock plate 12 to be fixed at substantially any arbitrary position. The pin 14, as shown in FIG. 2, has a head 43 and shank 44 that terminates at a free, chamfered end 45. A tether 46 ties the pin 14 to the portable lock 10, in this embodiment by being attached to the lock block 13.

The operation of the door lock, which comprises several simple and easily accomplished steps, will now be described in connection with FIG. 1. With the door 16 open, the door edge 23 is displaced from the latch side 24 of the frame 21. An individual in the room positions an end portion of the lock plate 12 such as the end portion 34 against the latch side 24 with the tongue 33 extending through the striker plate 30 into the recess 31. The block 32 is retracted to the other end portion 47 to be spaced from the frame 21 and to allow the door 16 to close on the lock 10.

When the door 16 closes, the proximity of the door edge 23 and latch edge 24 prevent the locking plate 12 from any significant displacement in the plane of the door. The tongue 33 therefore extends into the recess 31 and can not separate from the striker plate 30. Next the individual in the room slides the block 32 along the lock plate 12 until a first engaging surface 50 on the block 32 abuts the door 16. Then the individual tries to insert the lock pin 14 through the different apertures in the array 36 formed in the lock block 13.

As described above, the pin 14 will, with the pattern of apertures shown in FIG. 2, be blocked at all but one aperture in the array 36. At that position, the pin 14 will pass through the locking plate 12 and back plate 11 and fix the block 32 relative to the lock plate 12. If someone tries to open the door 16 while the lock 10 is in place, the engaging surface 50 will apply a force to the tongue 33 and striker plate 30 to the door frame 21. Consequently, the door 16 can not be opened.

Figure 3:
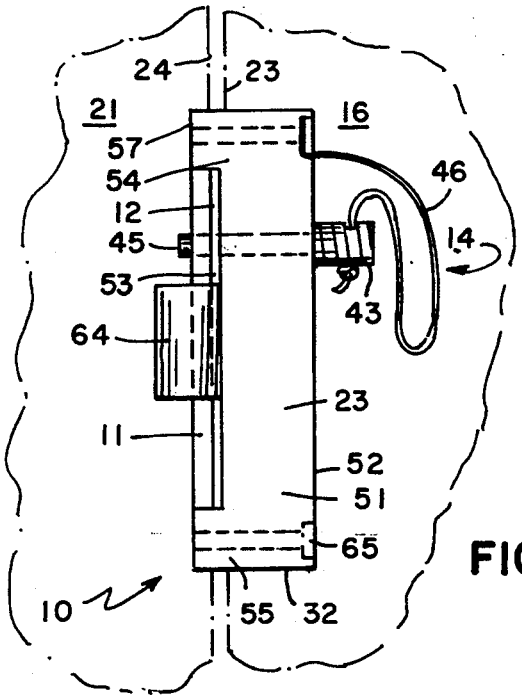
FIG. 3 is a rear elevational view of the portable door lock of FIG. 1.

This invention will now be more fully explained in conjunction with the FIGS. 2 and 3. With respect to the block 32, the lock block 13 can be formed of wood, plastic or other suitable material, normally with a substantially rectangular profile that includes the engaging surface 50 and an opposite, parallel engaging surface 51. A top surface 52 extends between the engaging surfaces 50 and 51 and serves as an exterior face. A spaced parallel side 53 engages the lock plate 12 and receives the back plate 11. Spaced ribs 54 and 55 on the side 53 extend between the engaging surfaces 50 and 51 and define a channel 56 that captures the lock plate 12. Additional ribs or blocks 57 and 60 extend from the surface of the rib 54 and corresponding ribs extend from the rib 55 to define a channel 61 or seat for receiving the back plate 11.

The back plate 11 comprises a relatively thin, planar, metal or high-strength plastic member. It retains the lock plate 12 against the lock block 13. More specifically, during assembly, the lock plate 12 will be located in the channel 53. Then the back plate 11 is positioned in the channel 61 and secured to the lock block 13. The height of the ribs 54 and 55 corresponds to the thickness of the lock plate 12. Consequently the ribs 54 and 55 spaced the back plate 11 from the channel 56 so that the lock plate 12 and block 32 can slide freely relative to each other. The ribs 57 and 60 also position the back plate 11 so its aperture array 35 aligns with the aperture array 36.

In this particular embodiment, machine screws 65 pass through countersunk lead holes 66 in the lock block 13 to engage tapped holes 67 in the back plate 11. As will be apparent and described later, alternate securing schemes can be substituted for this particular securing method. As will also now be apparent, the lock 10 shown in FIG. 2 is an integral structure once assembled. There are no separate parts to lose during use, storage or transport.

Referring to FIG. 2, the lock plate 12 is an elongated plate or sheet of tempered steel, stainless steel or high strength plastic with a substantially smooth finish. It comprises a substantially planar section or member 62 disposed between the spaced end sections 34 and 47. As depicted in FIG. 2, the lock plate 12 includes the tongue 33 at the first end portion 34, and second tongue 64 extending from the second end portion 47. Forming the lock plate 12 with tongues of different sizes increases the compatibility between a single portable lock 10 and different door configurations and locking arrangements. As will also be apparent, if the tongue 64 engages the striker plate 30, the second engaging surface 51 will abut the door and that the portable lock 10 will be equally useful with both right-handed and left-handed doors. In addition, the opposed tongues 33 and 64 capture the block 32 on the lock plate 12 after assembly.

Still referring to FIG. 2, each of the end portions 34 and 47 may also contain fingers extending parallel to the axis 37. For example, fingers 70 extend from the end portion 34; and fingers 71, from the end portion 47. These fingers 70 and 71 stabilize the portable lock during the interval between the time the door closes and the block 32 is fixed to the locking plate 12. If during this time an individual releases the portable lock 10, the lock 10 will tend to twist in the plane of the lock plate 12. However, if this occurs, fingers 70 or 71 engage portions of the door frame and hold the portable lock with the axis 37 substantially normal to the plane of the door.

In accordance with this invention, the proximate one of the bearing surfaces 50 and 51 engage the door 16 after, at most, incremental travel. This feature minimizes the likelihood of damage to the door even when someone tries to enter without authorization. Additionally, the lock 10 does not include any bearing surfaces which engage or bear on the exterior portions of a door frame such as molding 72 of FIG. 1. This minimizes the risk of damage to a door frame, since the present invention engages a frame only at a recess through the striker plate 30. The selection of materials for forming the lock block, including wood and plastic also reduce the likelihood of scratching, denting, and gouging of the door.

It will also be appreciated that each or all of the back plate, lock plate and :Lock block may be formed by molding plastic. For example, the back plate and lock block could be molded from plastic with integral locking portions to secure the lock block and back plate together. The block 32 could also be molded as an integral unit on a metal lock plate 12 or, by double molding techniques, over a plastic locking plate. Moreover, the block 32 is depicted as a rectangular structure with straight planar engaging surfaces 50 and 51. Other shapes and curved engaging surfaces could also be used.

In one prototype, the lock plate 12 is 6 inches long and 2 inches wide while the block 32 is about 2 to 4 inches square and about ½ inch thick. This prototype device weighs less than 8 ounces; and provides a relatively large, wooden engaging surface (approximately ½" by 2½") to engage a door opened against it. Applicant's invention therefore provides an integral portable door locking system which is relatively small and lightweight and which provides a significant bearing surface.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A portable door locking mechanism for releasably locking a door hinged on a frame along a distal side for movement between an open position and a closed position wherein the frame includes a striker plate and a recess in the frame behind the striker plate, said mechanism comprising:

A. a lock plate comprising an elongated planar section having an end portion for extending intermediate a door and a frame, a transversely extending tongue at said end portion for extending through a keeper into the frame recess thereby to engage the door frame, and a first pattern of apertures extending through said planar section and spaced from said end portion;

B. a block slidably mounted on said planar section with a door engaging surface transverse to said planar section and a second pattern of apertures extending through said block such that at different relative positions of said planar section and block at least one aperture in each of said first and said second patterns of apertures come into substantial registration;

C. a locking pin for insertion through substantially registered apertures of said first and said second patterns of apertures to fix said block relative to said plate and clamp the door to the door frame.

2. A portable door locking mechanism as recited in claim 1 wherein said second pattern of apertures of said block comprises a single column extending substantially transversely to a longitudinal axis of said lock plate.

3. A portable door locking mechanism as recited in claim 2 wherein said first pattern of apertures in said plate are arranged in a plurality of columns, each of said columns forming an angle with respect to the single column of said second pattern apertures in said block.

4. A portable door locking mechanism as recited in claim 1 wherein said second pattern of apertures in said block are formed in a column and said first pattern of apertures in said lock plate are formed in a plurality of columns with said column of apertures in said block being skewed with respect to each of said columns of apertures in said plate such that upon relative movement of said block with respect to said plate varying ones of said first and second pattern of apertures in said block and said plate substantially register.

5. A portable door locking mechanism as recited in claim 1 wherein said block includes a lock block disposed on a side of said lock plate opposite said tongue and a back plate extending transversely adjacent an opposite side of said lock plate and secured at opposite ends to said lock block such that said lock plate extends intermediate said lock block and is slidably secured on said back plate.

6. A portable door locking mechanism as recited in claim 5 wherein said pattern of apertures in said block include a pattern of apertures in said back plate and a patter of apertures in said lock block in registration within said pattern of apertures in said back plate such that said locking pin is extensible through ones of said apertures in said back plate and lock block.

7. A portable door locking mechanism as recited in claim 6 wherein said block is formed of wood.

8. A portable door locking mechanism as recited in claim 6 wherein said block is formed of plastic.

9. A portable door locking mechanism as recited in claim 5 additionally comprising means for attaching said locking pin to one of said block and said lock plate such that said lock plate, said block, and said pin form an integral locking mechanism.

10. A portable door locking mechanism as recited in claim 1 additionally comprising means for said locking pin attaching to one of said lock plate and said block such that said block, said lock plate and said locking pin form an integral locking mechanism.

11. A portable door locking mechanism as recited in claim 1 wherein said lock plate includes a second end section remote from said first end section and a second transverse tongue at said second end section.

12. A portable door locking mechanism as recited in claim 11 wherein an end of said lock plate is formed of steel.

13. A portable door locking mechanism as recited in claim 12 additionally comprising means for attaching said locking pin to one of said lock plate, back plate, and locking block such that said lock plate, said locking block, said back plate and said pin form an integral locking mechanism.

14. An integral portable door lock comprising:

A. a lock block having a pattern of apertures formed therein;

B. a back plate secured to said lock block to define a channel therebetween, said back plate having a second pattern of apertures formed therein in registration with said apertures in said lock block;

C. a lock plate slidably secured in said channel and including a substantially planar sheet having first and second oppositely disposed end portions sized for positioning intermediate a door and a frame, first and second transverse tongues extending from said first and said second end portions, respectively, and a third pattern of apertures extending through said lock plate intermediate said first and second end portions, such that at different relative positions of said lock plate with respect to said lock block and back plate at least one aperture in said third pattern comes into substantial registration with one set of aligned apertures in said lock block and back plate; and D. a peg flexibly fastened to said lock block having a body for insertion through said substantially registered apertures to fix said back plate and lock block relative to said lock plate.

15. An apparatus as recited in claim 14 wherein said lock block includes a portion formed of a material taken from the group of materials consisting of wood and plastics, said block having a substantially rectangular profile.

16. An apparatus as recited in claim 14 wherein said third pattern of apertures comprise a plurality of columns and each of said first and said second pattern of apertures comprise a column which is skewed with respect to said columns of said third pattern of apertures.

* * * * *